US006588417B2

(12) United States Patent
Jones et al.

(10) Patent No.: US 6,588,417 B2
(45) Date of Patent: Jul. 8, 2003

(54) REVERSIBLE BURNER GRATE

(75) Inventors: Matthew Charles Jones, Louisville, KY (US); Barry James Waddilove, Louisville, KY (US); Stephen Curtis Lesmeister, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,864

(22) Filed: Oct. 25, 2001

(65) Prior Publication Data

US 2003/0079739 A1 May 1, 2003

(51) Int. Cl.[7] ..... F24C 15/10
(52) U.S. Cl. ..... 126/215; 126/214 C
(58) Field of Search ..... 126/214 R, 214 C, 126/214 A, 9 R, 9 B, 25 R, 40, 50, 41 R, 38; D7/408, 409, 407, 346; 219/432, 433, 458, 459; 248/346.01

(56) References Cited

U.S. PATENT DOCUMENTS 730,268 A 6/1903 Keller
1,663,438 A * 3/1928 Brumbaugh ..... 126/215
2,164,619 A * 7/1939 McLeod ..... 126/215
4,435,638 A 3/1984 Simon et al.
4,607,613 A 8/1986 Toldi
5,315,983 A 5/1994 Law
5,372,121 A 12/1994 Castillo et al.
5,775,316 A 7/1998 Jones

FOREIGN PATENT DOCUMENTS

DE 385974 * 10/1939 ..... 126/214 R

OTHER PUBLICATIONS

"Cooktops," Fisher & Paykel, Issue Date Apr. 2001, Fisher & Paykel Appliances Inc., 27 Hubble, Irvine, CA 92618, USA, http://usa.fisherpaykel.com/CustomerCare/Brochures/pdfs/cooktopbroc.pdf.

* cited by examiner

*Primary Examiner*—James C. Yeung
(74) *Attorney, Agent, or Firm*—H. Neil Houser, Esq.; Armstrong Teasdale LLP

(57) ABSTRACT

A reversible cooktop grate includes a first side having a flat surface; and a second side extending opposite the first side. The second side includes a curved surface for accommodating a curved-bottomed cooking vessel.

23 Claims, 4 Drawing Sheets

REVERSIBLE BURNER GRATE

BACKGROUND OF INVENTION

This invention relates generally to cooking grates, and more particularly, to burner grates for gas cooking appliances.

Utensil supporting grates are typically employed with heat sources for cooking purposes. Meal preparations are placed into various cooking utensils, including but not limited to pots and pans, which, in turn, are conventionally positioned on flat supporting grates above the heat source to cook the meal preparations. In electric and gas-fired appliance cooktops, a plurality of flat burner grates are typically employed to cook multiple food preparations at selectively different heating levels at the same time. When used with flat bottomed cooking vessels, conventional cooking grates are satisfactory. However, flat cooking grates are generally incompatible with other types of cooking utensils, such as vessels with curved bottom surfaces.

Some cooking appliances are provided with adapter accessories for accommodating cooking utensils that are not flat on a conventional flat grate. For example, increasingly popular cooking woks include a smooth curved cooking surface. Cooktop accessories and adapters for woks are typically formed metal parts that attach to a flat burner grate to accommodate the spherical shape of the wok. See, for example, U.S. Pat. Nos. 4,607,613 and 5,315,983. These accessories and adapters, however, must be separately stowed when not in use. Further, when used with thick metal grates commonly employed in high end gas-fired cooktops, the adapter accessories can be cumbersome and difficult to attach or remove from a grate.

Special heating elements have also been provided to accommodate curved cooking utensils and vessels, such as a wok. See, for example, U.S. Pat. No. 4,435,638. However, specially designed burners for curved cooking vessels are not generally compatible with flat-bottomed cooking elements that are also desirable to use.

Additionally, interchangeable flat grates and wok rings have been proposed for cooktops to convert cooking stations for use with flat bottomed cooking vessels and curved bottom vessels, such as a wok, by substituting a wok ring in place of the grate, or vice versa. See, for example, U.S. Pat. No. 5,775,316. To achieve full versatility of the cooktop, however, a complete set of wok rings and grates are required that must be stored separately when not in use.

SUMMARY OF INVENTION

In one aspect, a reversible cooktop grate is provided. The grate comprises a first side comprising a flat surface and a second side extending opposite said first side. The second side comprises a curved surface for accommodating a curved-bottomed cooking vessel.

In another aspect, a reversible cooktop grate is provided that comprises an outer rim and intersecting cross member supports extending from said rim. The cross member supports comprise a flat side and curved side extending opposite said flat side, said curved side comprising a concave shaped area for receiving a curved cooking vessel.

In another aspect, a reversible grate assembly is provided. The assembly comprises a frame and a reversible grate received in said frame. The grate comprises an outer rim and first and second side surfaces extending on opposite sides of said rim, each of said surfaces adapted for cooking thereupon, one of said surfaces curved to accommodate a curved bottom of a cooking vessel.

In still another aspect, a cooktop is provided which comprises at least one heating element and at least one reversible grate positioned above said heating element. The grate comprises opposite sides, each said side configured for cooking operation, and one of said sides comprising a curved nesting surface for a curved cooking vessel.

DETAILED DESCRIPTION

Figure 1:
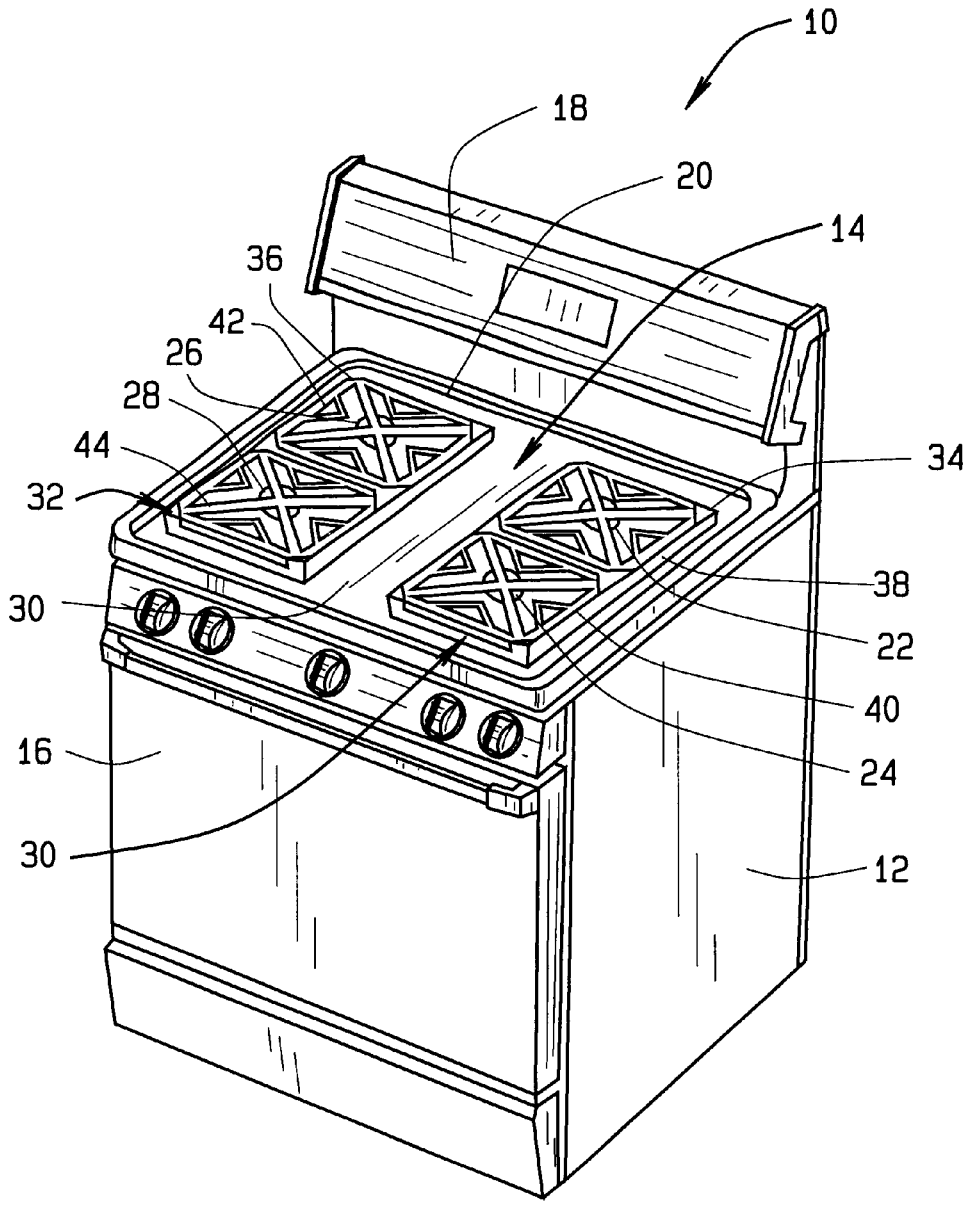
FIG. 1 is a perspective view of a gas range incorporating one embodiment of a reversible grate assembly.

FIG. 1 illustrates a free standing gas range 10 with an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and contains various control selectors (not shown) for selecting operative features of heating elements for cooktop 14 and the oven. It is contemplated that the present invention is applicable, not only to cooktops which form the upper portion of a range, such as range 10, but to other forms of cooktops as well, such as, but not limited to, free standing cooktops that are mounted to kitchen counters. Therefore, gas range 10 is provided by way of illustration rather than limitation, and accordingly there is no intention to limit application of the present invention to any particular appliance or cooktop, such as range 10 or cooktop 14.

Cooktop 14 includes four gas fueled burners 22, 24, 26, 28 which are positioned in, spaced apart pairs 22, 24 and 26, 28 positioned adjacent each side of cooktop 14. Each pair of burners 22, 24 and 26, 28 is surrounded by a recessed area (not shown in FIG. 1) respectively, of cooktop 14. The recessed areas are positioned below the upper surface 30 of cooktop 14 and serve to catch any spills from cooking utensils (not shown in FIG. 1) being used with cooktop 14. Each burner 22, 24, 26, 28 extends upwardly through an opening in cooktop 14, and a grate assembly 30, 32 is positioned over each respective pair of burners, 22, 24 and 26, 28. Each grate assembly 30, 32 includes a respective frame 34, 36, and separate utensil supporting grates 38, 40, 42,44 are positioned above the cooktop recessed areas and overlie respective burners 22, 24, 26, 28.

The construction and operation of the range heating elements, including cooktop gas burners 22, 24, 26, 28 are believed to be within the purview of those in the art without further discussion, and as details of the range heating elements and controls are generally beyond the scope of the present invention, further description thereof is omitted. Further, it is contemplated that the invention may find utility in combination with other heat sources besides gas burners for reversible cooking operation.

While cooktop 14 includes two pairs of grate assemblies 34, 36 positioned over two pairs of burners 22, 24 and 26, 28, it is contemplated that greater or fewer numbers of grate assemblies 30, 32 could be employed with a greater or fewer number of burners without departing from the scope of the present invention. Moreover, grate assembly frames 34, 36 could likewise accommodate greater or fewer grates than the illustrated grates 38, 40, 42, 44. Still further, grate assemblies 34, 36 in one embodiment are substantially identical. It is appreciated, however, that in alternative embodiments grate assemblies 34, 36 need not be identical.

Unlike known grates, grates 38, 40, 42, 44 are reversible and include a first side (shown in FIG. 1) for accommodating flat-bottomed cooking vessels, and a second side (not shown in FIG. 1) for accommodating curved-bottomed cooking utensils, such a wok (not shown in FIG. 1). Therefore, by appropriately placing the desired side up for each grate 38, 40, 42, 44, cooking stations of cooktop 14 associated with respective burners 22, 24, 26, 28 can be used with flat-bottomed vessels or curved-bottomed vessels as desired. Reversible grates 38, 40, 42, 44 therefore allow maximum versatility of burners 22, 24, 26, 28 in use without requiring the cost and inconvenience of separately purchased and separately stored accessories to accommodate curved-bottomed cooking utensils. Each of the four burners 22, 24, 26, 28 can therefore be satisfactorily used with flat-bottomed cooking vessels and curved-bottomed cooking vesels without requiring external adapters or accessories.

Figure 2:
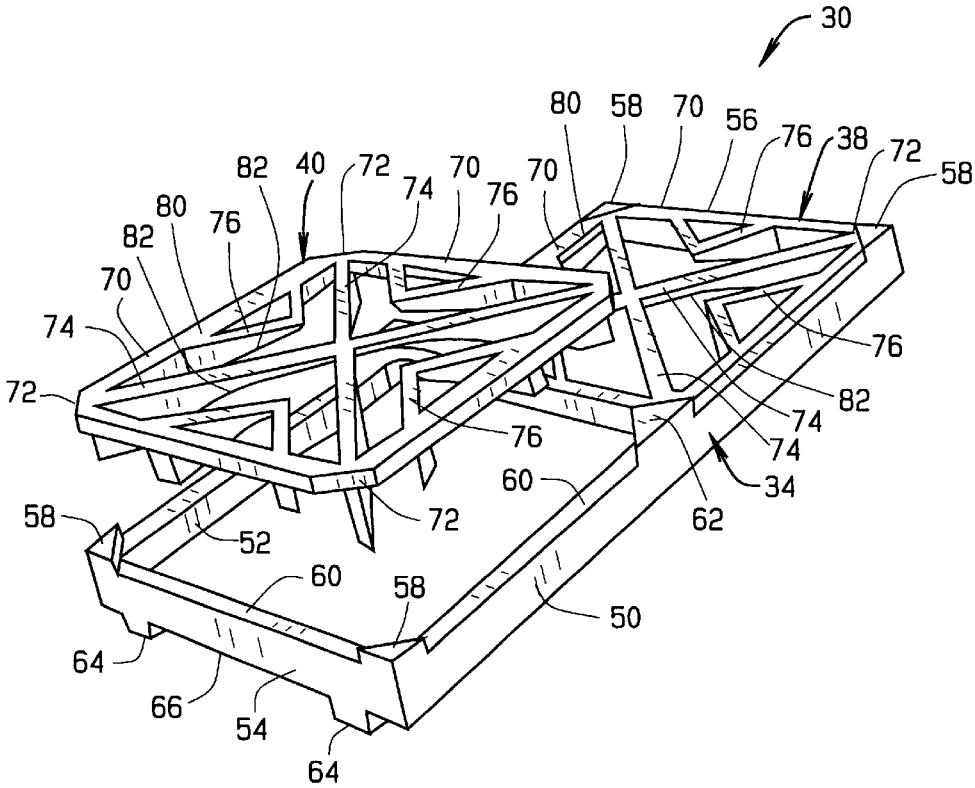
FIG. 2 is a perspective assembly view of the reversible grate assembly shown in FIG. 1.

FIG. 2 is a perspective assembly view of reversible grate assembly 30 including frame 34 and reversible grates 38, 40. Frame 34 in one embodiment is substantially rectangular and includes elongated lateral sides 50, 52 extending substantially parallel to one another, and end sides 54, 56 extending generally perpendicular to elongated sides 50, 52 and joining respective ends thereof Grate retaining tabs 58 extend upwardly from a top surface 60 of frame 34 at each intersecting end of frame sides 50, 52, 54, 56, and medial grate retaining tabs 62 extend upwardly from frame top surface 60 and are positioned approximately equidistantly between respective ends of frame lateral sides 50, 52. In one embodiment, retaining tabs 58, 62 are substantially triangular, although in alternative embodiments it is contemplated that alternative shapes for retaining tabs 58, 62 may be employed, including shapes with one or more curved sides, without departing from the scope of the present invention.

Frame footings 64 depend downwardly from a lower surface 66 of frame 34 for supporting frame 34 upon a cooktop or retaining frame 34 to a cooktop, such as cooktop 14 (shown in FIG. 1) when footings 64 are engaged to a cooktop surface or inserted through openings in the cooktop, as desired. It is recognized, however, that grates 38, 40 may be used as stand alone components on a cooktop, i.e., without frame 34. It is further recognized that grates 38, 40 may be used over heat sources other than cooktop heating elements, such as, for example, an open flame.

Grates 38, 40 include an outer a substantially square outer rim 70 with exterior corner cutouts 72 that abut frame retaining tabs 58 and 62. Cross member supports 74 extend diagonally between corner cutouts 72 and intersect at an approximate center of each grate 38, 40. V-shaped leg supports 76 extend from rim 70 between grate corners 72 with the apex of the V pointing towards the center of the grate, and leg supports 76 are disposed in a spaced relationship with grate cross member supports 74, thereby forming V-shaped openings between cross member supports 74 and leg supports 76. Triangular openings extend between V-shaped leg supports 76 and grate rim 70. Grate rim 70, cross member supports 74, and leg supports 76 are dimensioned to capably support cooking utensils while also facilitating heat transfer from a heating element, such as burners 22 and 24 (shown in FIG. 1) through the openings in the grate.

It is contemplated that in alternative embodiments grates of other shapes may be employed, including but not limited to grates with round rims, albeit with appropriate modification to frame 34.

Grates 38, 40 are fitted between frame retaining tabs 58, 62, and grate rims 70 rest upon frame top surface 60 in use. Grates 38, 40 each include a first side surface 80 that is substantially flat or planar and extends over or spans top surfaces of grate rim 70, cross member supports 74 and leg supports 76. A second side surface 82 is disposed opposite first side surface 80 and is curved. Second side surface 82 extends over bottom surfaces of cross member supports 74 and leg supports 76 to accommodate curved-bottomed cooking vessels, such as hemispherically-shaped wok cooking utensils. Therefore, by reversing the orientation of grates 38, 40 relative to frame 34, each grate 38, 40 may be equally employed with flat-bottomed cooking utensils and curved bottom cooking utensils. Separately stored, external adapters and accessories for curved-bottomed cooking vessels, such as woks, are therefore avoided, together with the associated expense and inconvenience.

Figure 3:
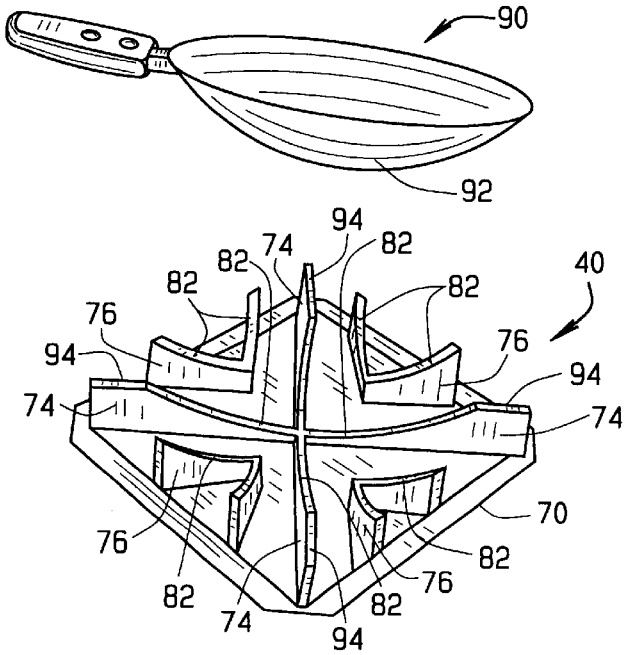
FIG. 3 is a perspective assembly view of one of the reversible grates shown in FIG. 2.

FIG. 3 is a perspective assembly view of grate 40 illustrating curved second side surface 82 extending over cross member supports 74 and leg supports 76 and generally above flat rim 70. Curved second side surface 74 defines a concave shape for receiving a curved-bottomed cooking vessel 90 having a convex bottom surface 92. In one embodiment, vessel 90 is a wok having a hemispherical shaped bottom surface, and grate second side surface 82 is shaped to substantially conform to curved vessel outer surface 92. When vessel 92 is seated upon grate second side surface, vessel 90 is nested in grate second side surface 82. As such, vessel 90 is adequately supported and heat from the burner is transferred to vessel bottom surface 92 through the openings in grate 40 between cross member supports 40 and leg supports 76 and also between leg supports 76 and outer rim 70.

In the illustrated embodiment, cross member supports 74 include flat segments 94 adjacent rim 70. As such, flat items may be accommodated on top of second side surface 82, or alternatively, when placed curved side down on a cooktop, countertop, or other flat surface, grate 40 will rest on flat segments 94 in a stable position. In alternative embodiments, curved second side surface 82 is employed end-to-end (i.e., without flat segments 94) on cross member supports 74 to further cradle bottom surface 92 of cooking vessel 90.

Figure 4:
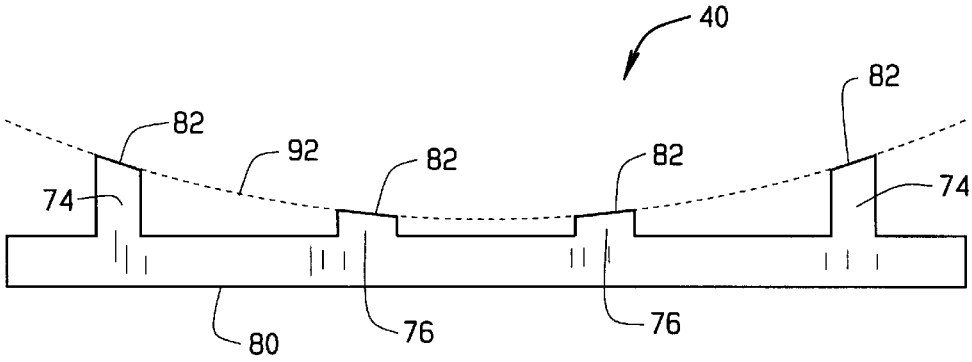
FIG. 4 is a functional cross sectional schematic of the reversible grate shown in FIG. 3.

FIG. 4 is a functional cross sectional schematic of reversible grate 40 including cross member supports 74 and leg supports 76 in spaced apart relationship to one another for supporting a curved cooking vessel, such as vessel 90 (shown in FIG. 3). Top surfaces of cross member supports 74 and leg supports 76 are curved to collectively form a curved surface 82 that capably supports a curved bottom surface 92 (shown in phantom in FIG. 4) of a cooking vessel. As such, a curvature of surfaces 82 of cross member supports 74 and leg supports 76 is approximately equal to the curvature of cooking vessel bottom surface 92, and it is understood that surfaces 82 could be modified to support a variety of differently shaped cooking vessels having different curvatures. Flat surface 80 extends opposite curved surface 82 for cooking with conventional flat-bottomed vessels. Thus, by orienting grate 40 flat side-up or curved side-up, grate 40 may be used equally with flat and curved-bottomed cooking vessels.

Figure 5:
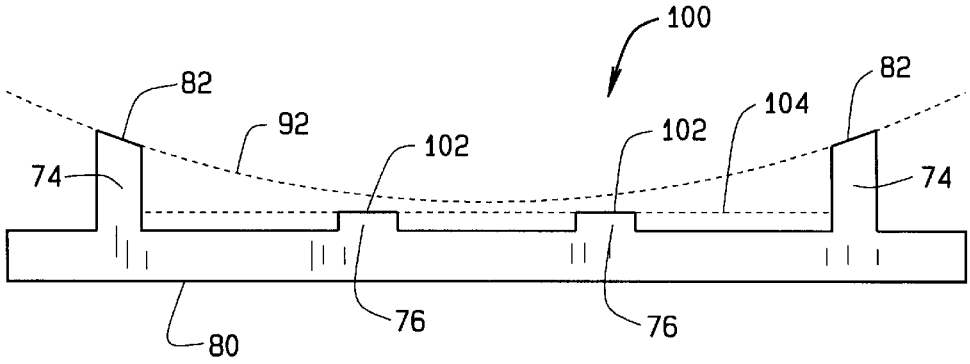
FIG. 5 is functional cross sectional schematic of a second embodiment of a reversible grate.

FIG. 5 is functional cross sectional schematic of a second embodiment of a reversible grate in which like elements of grate 40 (shown in FIGS. 3 and 4) are indicated with like reference characters.

Grate 100 includes cross member supports 74 and leg supports 76 in spaced apart relationship to one another and adapted for supporting both a curved cooking vessel, such as vessel 90 (shown in FIG. 3) and a flat-bottomed cooking vessel. Top surfaces of cross member supports 74 are curved to collectively form a curved surface 82 that capably supports a curved bottom surface 92 (shown in phantom in FIG. 4) of a cooking vessel. A curvature of surfaces 82 of cross member supports 74 is approximately equal to the curvature of cooking vessel bottom surface 92, and it is recognized that surfaces 82 could be modified to support a variety of differently shaped cooking vessels having different curvatures.

Unlike grate 40, however, top surfaces of leg supports 76 each include substantially flat surfaces 102 providing a sufficient clearance for cooking vessel curved bottom surface 92 so as not to interfere with curved bottom surface 92 and render the associated cooking vessel unstable, yet simultaneously providing a flat surface 102 for supporting a cooking vessel flat bottom 104 (shown in phantom in FIG. 5). In one embodiment, a spacing of cross member supports 74 and leg supports 76 facilitates use of a 9 inch flat bottom pan for cooking on flat surface 102 between cross member supports 74. It is understood, however, that spacing of cross member supports 74 and support legs 76 may be further varied in alternative embodiments to accommodate cooking vessels and utensils of different sizes upon flat cooking surface 102. Of course, flat surface 80 extends opposite surfaces 82 and 102 to accommodate larger flat-bottomed bottomed cooking vessels that may be accommodated between cross member supports 74.

Therefore, grate 100 capably supports both flat-bottomed cooking vessels and curved-bottomed cooking vessels without external accessories and without the inconvenience of reversing grate 100 for use with smaller-flat bottomed cooking vessels. Flat surface 80 extends opposite curved surface 82 for cooking with larger flat-bottomed vessels when grate 100 is oriented flat side-up.

Figure 6:
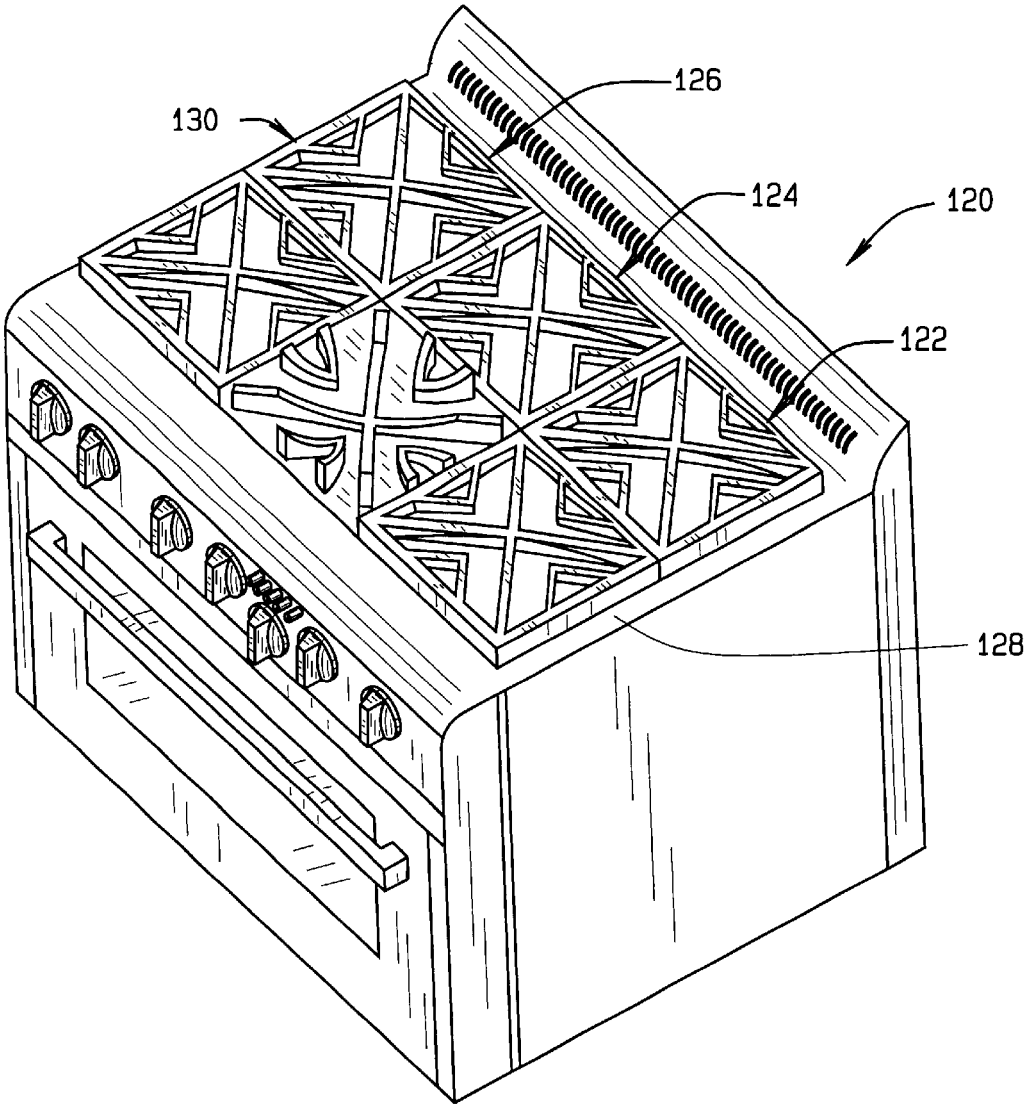
FIG. 6 is a perspective view of a second embodiment of a gas range incorporating a plurality of reversible grate assemblies.

FIG. 6 is a perspective view of a second embodiment of a gas range 120 incorporating a plurality of reversible grate assemblies 122, 124, 126 arranged side-by-side on a cooktop 128 to form a continuous cooking surface 130. In an exemplary embodiment, each of grates 122, 124, 126 are substantially similar to grate assembly 30 described above in relation to FIG. 2, and any of the foregoing grate embodiments may be equally employed in grate assemblies 122, 124, 126.

As illustrated in FIG. 6, one of the grates for assembly 124 is oriented curved side-up for use with a curved cooking vessel, such as a wok, while the other grate is oriented flat side-up for use with flat-bottomed cooking vessels. In addition, each grate of assemblies 122 and 126 are oriented-flat side-up to form a large and continuous cooking surface around the grate in assembly 124 that is disposed curved-side up. It is believed that the advantages of a large continuous cooking surface are apparent, readily appreciated by, and desired by those in the culinary arts.

Furthermore, by virtue of grate assemblies 122, 124, 126, it is noted that cooktop 130 may accommodate up to six curved cooking vessels at the same time, thereby facilitating preparation of a relatively large amount of food in a reduced time. It is appreciated, however, that additional grate assemblies could be employed to further increase food preparation capacity for commercial and institutional settings.

While the invention has been described in terms of various specific embodiments, those skilled in the art will recognize that the invention can be practiced with modification within the spirit and scope of the claims.

What is claimed is:

1. A reversible cooktop grate comprising:

a plurality of supports defining a first cooking surface, said first cooking surface substantially coplanar on one side thereof; and at least some of said supports defining a second cooking surface extending opposite said first cooking surface, said second cooking surface comprising a curved surface for accommodating a curved-bottomed cooking vessel.

2. A grate in accordance with claim 1 further comprising a rim, said plurality of supports comprising cross member supports defining said first cooking surface.

3. A grate in accordance with claim 2 wherein said cross member supports further define said second cooking surface.

4. A grate in accordance with claim 2 further comprising V-shaped leg supports spaced from said cross member supports.

5. A grate in accordance with claim 4, said V-shaped supports comprising a flat side and a curved side opposite said flat side.

6. A grate in accordance with claim 2 wherein said rim comprises a substantially rectangular rim with corner cutouts.

7. A reversible cooktop grate comprising:

an outer rim; and intersecting cross member supports extending from said rim, said cross member supports comprising a flat side and curved side extending opposite said flat side, said curved side comprising a concave shaped area for receiving a curved cooking vessel.

8. A grate in accordance with claim 7 further comprising leg supports extending from said rim in spaced relationship with said cross member supports.

9. A grate in accordance with claim 8 wherein said leg supports comprise a first flat surface and a second curved surface extending opposite said first flat surface.

10. A grate in accordance with claim 9 wherein said flat surface of said leg supports are flush with said flat surface of said cross member supports, said curved surface of said leg supports further defining said concave shaped area.

11. A grate in accordance with claim 7 wherein said rim is substantially rectangular.

12. A grate in accordance with claim 11 further comprising V-shaped openings extending between said cross member supports and said leg supports.

13. A grate in accordance with claim 7 wherein said cross member supports further comprises a flat segment extending adjacent said curved side.

14. A reversible grate assembly comprising:

a frame; and a reversible grate received in said frame, said grate comprising an outer rim and first and second side surfaces extending on opposite sides of said rim, each of said surfaces adapted for cooking thereupon and defined by a plurality of supports depending inwardly from said rim, one of said surfaces curved to accommodate a curved bottom of a cooking vessel, the other of said surfaces substantially flat and coplanar.

15. A reversible grate assembly in accordance with claim 14 wherein said rim is substantially square.

16. A reversible grate assembly in accordance with claim 14, said frame comprising a top surface and grate positioning tabs extending from said top surface, and wherein said rim comprises cutout portions to accommodate said grate positioning tabs.

17. A reversible grate assembly in accordance with claim 16 wherein said grate positioning tabs are substantially triangular.

18. A reversible grate assembly in accordance with claim 16 wherein said plurality of supports comprises intersecting cross member supports extending from said rim.

19. A cooktop comprising:

at least one heating element;

a frame comprising a top surface and grate positioning tabs extending upwardly therefrom; and at least one reversible grate positioned above said heating element within said frame, said grate comprising opposite sides, each said side configured for cooking operation, one of said sides comprising a curved nesting surface for a curved cooking vessel.

20. A cooktop in accordance with claim 19 wherein said reversible grate is received on said frame top surface between said grate positioning tabs.

21. A cooktop in accordance with claim 19 further comprising a plurality of frames and a plurality of grates, at least two of said grates forming a continuous cooking surface.

22. A cooktop in accordance with claim 19 wherein said reversible grate comprises an outer rim and intersecting cross supports extending from said rim, said intersecting cross supports having a flat surface on one side and curved surface on another side.

23. A cooktop in accordance with claim 19 wherein said reversible grate comprises an outer rim and a plurality of leg supports depending from said outer rim, each of said leg supports comprising a flat side and a curved side opposite said flat side, said curved sides forming a curved nesting surface for a curved cooking vessel.

* * * * *